US012152805B2

(12) United States Patent
Palomäki et al.

(10) Patent No.: US 12,152,805 B2
(45) Date of Patent: Nov. 26, 2024

(54) WINDOW AIR CONDITIONING UNIT INSTALLATION SYSTEM

(71) Applicant: Electrolux Appliances Aktiebolag, Stockholm (SE)

(72) Inventors: Zack Palomäki, Stockholm (SE); Arturas Daugela, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 428 days.

(21) Appl. No.: 17/559,525

(22) Filed: Dec. 22, 2021

(65) Prior Publication Data

US 2023/0194123 A1 Jun. 22, 2023

(51) Int. Cl.

| | |
|---|---|
| ***F24F 13/32*** | (2006.01) |
| ***F24F 1/027*** | (2019.01) |
| ***F24F 1/04*** | (2011.01) |
| ***F24F 13/12*** | (2006.01) |
| ***F24F 13/20*** | (2006.01) |

(52) U.S. Cl.

CPC ..... *F24F 13/32* (2013.01); *F24F 1/027* (2013.01); *F24F 1/04* (2013.01); *F24F 13/12* (2013.01); *F24F 13/20* (2013.01); *F24F 2221/20* (2013.01)

(58) Field of Classification Search

CPC ..... F24F 2221/20; F24F 13/32; F24F 13/12; F24F 13/20; F24F 1/04; F24F 1/027; F24F 1/031; F24F 5/0075; F24F 2005/0078; F24F 13/18; F24F 13/224

See application file for complete search history.

(56) References Cited

U.S. PATENT DOCUMENTS

| | | | |
|---|---|---|---|
| 399,491 | A | 3/1889 | Bukawietis |
| 1,954,017 | A | 4/1934 | Manning |
| 2,234,753 | A | 3/1941 | Frazer |
| 2,268,451 | A | 12/1941 | Hull |
| 2,320,436 | A | 6/1943 | Hull |
| 2,436,713 | A | 2/1948 | Cody |
| 2,568,968 | A | 9/1951 | Perrin |

(Continued)

FOREIGN PATENT DOCUMENTS

| | | | |
|---|---|---|---|
| CN | 2190590 | Y | 3/1995 |
| CN | 2413205 | Y | 1/2001 |

(Continued)

OTHER PUBLICATIONS

Chinese Office Action for Chinese Application No. 201980102818.5, dated Sep. 1, 2023, 8 pages.

(Continued)

*Primary Examiner* — Miguel A Diaz

(74) *Attorney, Agent, or Firm* — Bradley Arant Boult Cummings LLP

(57) ABSTRACT

A window air conditioner installation system comprising a top rail, a bottom rail, a first vertical rail configured to connect to the top rail and the bottom rail, and a second vertical rail configured to connect to the top rail and the bottom rail. A clamp fixture is connected to the top rail, and a clamp is movably mounted to the clamp fixture. The clamp is movable between a first clamp position in which a clamp face is a first distance from the top rail in a depth direction, a second clamp position in which the clamp face is a second distance from the top rail in the depth direction.

19 Claims, 8 Drawing Sheets

(56) References Cited

U.S. PATENT DOCUMENTS 2,608,148 A 8/1952 Shapiro
2,814,244 A 11/1957 Hord
2,818,793 A 1/1958 Hord
2,925,026 A 2/1960 Schuster et al.
2,935,284 A 5/1960 Reeves
3,030,873 A 4/1962 Metcalfe
3,134,319 A 5/1964 Marsteller
3,476,033 A 11/1969 Appel
3,481,264 A 12/1969 Ulich
3,491,549 A 1/1970 Oglesby
3,552,470 A 1/1971 Metcalfe
3,554,476 A 1/1971 Gaylor, Jr.
3,698,208 A 10/1972 Navara
3,698,308 A 10/1972 Navara
3,911,803 A 10/1975 Kong et al.
4,086,886 A 5/1978 Edmaier et al.
4,152,844 A 5/1979 Materniak et al.
4,203,302 A 5/1980 Lapeyre
4,334,461 A 6/1982 Ferguson et al.
5,027,614 A 7/1991 Mori et al.
5,167,131 A 12/1992 Karkhanis
5,290,343 A 3/1994 Morita et al.
5,295,903 A * 3/1994 Bolton ..... F24F 1/027 454/203
5,365,992 A 11/1994 Swain et al.
5,582,025 A 12/1996 Dubin et al.
5,823,289 A 10/1998 Csomos
5,979,172 A 11/1999 Teller
5,979,533 A 11/1999 Dupuie
6,173,930 B1 1/2001 Arbucci
6,257,013 B1 7/2001 Murray et al.
6,416,570 B2 7/2002 Goto et al.
6,568,201 B1 5/2003 Cur et al.
6,767,278 B1 7/2004 Peterson
6,983,621 B2 1/2006 Cur et al.
7,121,105 B1 10/2006 Rais
7,296,424 B2 11/2007 Thompson
7,332,019 B2 2/2008 Bias et al.
7,350,759 B1 4/2008 Gray
7,601,204 B2 10/2009 Woodruff et al.
7,854,141 B1 10/2010 Breen
7,896,957 B2 3/2011 Zhao et al.
7,975,441 B2 7/2011 McCarriston
8,091,844 B1 1/2012 Bragg
8,104,240 B2 1/2012 McCarriston
8,578,728 B2 11/2013 Cho et al.
8,584,998 B1 11/2013 Peterson
9,163,854 B2 10/2015 Arbuccci
9,179,794 B2 11/2015 Darby
9,303,895 B1 4/2016 Grant
9,447,916 B2 9/2016 Darby et al.
D782,289 S 3/2017 Darby et al.
9,605,870 B2 3/2017 Darby et al.
9,909,712 B1 3/2018 Darby
9,938,044 B2 4/2018 Gamboa
9,982,909 B1 5/2018 Perez et al.
10,077,918 B2 9/2018 Darby et al.
10,104,964 B2 10/2018 Darby
10,203,130 B2 2/2019 Gardikis et al.
10,203,180 B2 2/2019 Miller et al.
10,295,221 B2 5/2019 Zhang
10,359,212 B2 7/2019 Darby
10,401,043 B2 9/2019 Li
10,408,494 B2 9/2019 Darby
10,520,206 B2 12/2019 Xu et al.
10,712,058 B2 7/2020 Itakura et al.
10,775,054 B2 9/2020 Bradford et al.
10,900,689 B2 1/2021 Weiner
2001/0032545 A1 10/2001 Goto et al.
2003/0097854 A1 5/2003 Cur et al.
2003/0110789 A1 6/2003 Cur et al.
2005/0028545 A1 2/2005 Herbert
2005/0138940 A1* 6/2005 Spanger ..... F24F 13/222 62/150
2006/0021359 A1 2/2006 Hur et al.
2006/0223434 A1 10/2006 Barker
2007/0023592 A1 2/2007 Makaso
2007/0068185 A1 3/2007 Thompson
2007/0137237 A1 6/2007 Rais
2008/0053309 A1 3/2008 Woodruff et al.
2008/0104989 A1 5/2008 Movshovitz
2010/0077924 A1 4/2010 Zhao et al.
2010/0197214 A1* 8/2010 Geremia, Sr. ..... F24F 13/18 454/251
2010/0229585 A1 9/2010 Bradford et al.
2010/0326103 A1 12/2010 Stamm et al.
2012/0137499 A1 6/2012 Agnihotri
2012/0274188 A1 11/2012 Shiborino
2013/0104581 A1 5/2013 Consoli
2013/0153744 A1 6/2013 Jin et al.
2013/0327509 A1 12/2013 Michitsuji
2014/0020421 A1 1/2014 Gallo
2014/0076506 A1 3/2014 Olivas
2014/0090334 A1 4/2014 Darby et al.
2014/0311063 A1 10/2014 McIntyre
2015/0034784 A1 2/2015 Darby
2015/0097096 A1 4/2015 Arbucci
2015/0211802 A1 7/2015 Yokozeki et al.
2015/0354838 A1 12/2015 Cur et al.
2016/0033166 A1 2/2016 Herbert
2016/0058189 A1 3/2016 Darby
2016/0097547 A1 4/2016 Selg et al.
2016/0298872 A1 10/2016 Darby et al.
2017/0153041 A1 6/2017 Darby et al.
2017/0159948 A1 6/2017 Darby
2017/0191763 A1 7/2017 Xu et al.
2017/0254557 A1 9/2017 Chiu
2017/0284683 A1 10/2017 Gallo et al.
2017/0297768 A1 10/2017 Gamboa
2017/0328596 A1* 11/2017 Darby ..... F24F 13/32
2018/0023842 A1 1/2018 Gardikis, Sr. et al.
2018/0180305 A1 6/2018 Zhang
2019/0056143 A1 2/2019 Zhang
2019/0063760 A1 2/2019 Li
2019/0212028 A1 7/2019 Zemborain et al.
2019/0212032 A1 7/2019 Galvan
2020/0124296 A1 4/2020 Baumann et al.
2020/0248911 A1 8/2020 Lei et al.
2020/0333021 A1 10/2020 Galvan
2020/0363075 A1 11/2020 Bradford et al.
2021/0010688 A1 1/2021 Biasotti et al.
2021/0078118 A1 3/2021 Li et al.
2021/0088251 A1 3/2021 Martinez Galvan et al.
2021/0180828 A1 6/2021 Xing et al.
2021/0356146 A1 11/2021 Zhang et al.
2021/0404749 A1 12/2021 Wexler et al.

FOREIGN PATENT DOCUMENTS

CN 1338593 A 3/2002
CN 1445491 A 10/2003
CN 1595005 A 3/2005
CN 1727764 A 2/2006
CN 201104001 Y 8/2008
CN 201249077 Y 6/2009
CN 101523120 A 9/2009
CN 201589348 U 9/2010
CN 103471223 A 12/2013
CN 203379993 U 1/2014
CN 203501389 U 3/2014
CN 203518172 U 4/2014
CN 104061632 A 9/2014
CN 203980467 U 12/2014
CN 204141751 U 2/2015
CN 204153874 U 2/2015
CN 204202053 U 3/2015
CN 204491248 U 7/2015
CN 105202831 A 12/2015
CN 205037425 U 2/2016
CN 205137735 U 4/2016
CN 106152315 A 11/2016
CN 106949559 A 7/2017
CN 206369283 U 8/2017
CN 107980091 A 5/2018

(56) References Cited

FOREIGN PATENT DOCUMENTS

| | | | |
|---|---|---|---|
| CN | 207963242 | U | 10/2018 |
| CN | 108800686 | A | 11/2018 |
| CN | 109073269 | A | 12/2018 |
| CN | 109631434 | A | 4/2019 |
| DE | 4230604 | A1 | 3/1994 |
| EP | 0756140 | A2 | 1/1997 |
| EP | 1248049 | A2 | 10/2002 |
| EP | 1956307 | A1 | 8/2008 |
| EP | 2063192 | A1 | 5/2009 |
| EP | 2602420 | A2 | 6/2013 |
| EP | 3276279 | A1 | 1/2018 |
| FR | 755472 | A | 11/1933 |
| GB | 212669 | | 3/1924 |
| GB | 1239997 | | 7/1971 |
| GB | 2126695 | A | 3/1984 |
| JP | 54105838 | A | 8/1979 |
| JP | 07248128 | A | 9/1995 |
| JP | 08226745 | A | 9/1996 |
| JP | 08285413 | A | 11/1996 |
| JP | 2000002474 | A | 1/2000 |
| JP | 2001239121 | A | 9/2001 |
| JP | 2002357338 | A | 12/2002 |
| JP | 2009144984 | A | 7/2009 |
| JP | 2012132640 | A | 7/2012 |
| JP | 2018123717 | A | 8/2019 |
| KR | 20050117664 | A | 12/2005 |
| KR | 20070077917 | A | 7/2007 |
| KR | 20160086637 | A | 7/2016 |
| KR | 20160111687 | A | 9/2016 |
| KR | 102187381 | B1 | 12/2020 |
| KR | 20210077328 | A | 6/2021 |
| WO | 8800676 | A1 | 1/1988 |
| WO | 0190657 | A1 | 11/2001 |
| WO | 2005054751 | A2 | 6/2005 |
| WO | 2005116530 | A1 | 12/2005 |
| WO | 2009052372 | A2 | 4/2009 |
| WO | 2011079371 | A1 | 7/2011 |
| WO | 2012056164 | A1 | 5/2012 |
| WO | 2014188526 | A1 | 11/2014 |
| WO | 2014206846 | A1 | 12/2014 |
| WO | 2015098157 | A1 | 7/2015 |
| WO | 2015115929 | A1 | 8/2015 |
| WO | 2017001914 | A1 | 1/2017 |
| WO | 2017045909 | A1 | 3/2017 |
| WO | 2017045934 | A1 | 3/2017 |
| WO | 2017075658 | A1 | 5/2017 |
| WO | 2017194092 | A1 | 11/2017 |
| WO | 2018090114 | A1 | 5/2018 |
| WO | 2020038239 | A1 | 2/2020 |

OTHER PUBLICATIONS

Chinese Office Action for Chinese Application No. 201680085261.5, dated Apr. 14, 2020, 11 pages. 2020.
Chinese Office Action for Chinese Application No. 201680085261.5, dated Dec. 11, 2020, with translation, 28 pages. 2020.
European Communication pursuant to Article 94(3) for European Application No. 16 721 184.6, dated Oct. 7, 2020, 7 pages. 2020.
International Search Report and Written Opinion for International Application No. PCT/IB2016/000949, dated Nov. 2, 2016, 9 pages. 2017.
International Search Report and Written Opinion for International Application No. PCT/EP2016/060396, dated Jan. 24, 2017, 9 pages. 2018.
International Search Report and Written Opinion for International Application No. PCT/EP2016/070382, dated Dec. 1, 2016, 14 pages. 2018.
International Search Report and Written Opinion for International Application No. PCT/EP2016/070702, dated Dec. 9, 2016, 9 pages. 2018.
Non Final Office Action for U.S. Appl. No. 16/771,107, dated Feb. 8, 2022, 11 pages.
Non Final Office Action for U.S. Appl. No. 16/771,111, dated Mar. 10, 2023, 13 pages.
Non Final Office Action for U.S. Appl. No. 17/558,962, mailed Jun. 13, 2023, 16 pages.
Chinese Office Action for Chinese Application No. 2016800860880, dated Jan. 26, 2021, with translation, 18 pages.
International Search Report and Written Opinion for International Application No. PCT/EP2016/062022, dated Jan. 23, 2017—9 pages.
Chinese Office Action for Chinese Application No. 2016800860880, dated May 7, 2020, 8 pages.
Non Final Office Action for U.S. Appl. No. 16/771,456, dated Nov. 10, 2021, 39 pages.
Non Final Office Action for U.S. Appl. No. 16/771,111, dated Dec. 21, 2021, 41 pages.
"Evidence for Common Knowledge," 2014, 6 pages.
Chinese Office Action for Chinese Application No. 201780097448.1, dated Jun. 29, 2021, with translation, 14 pages.
Chinese Office Action with Search Report for Application No. 201780097448.1, dated Jan. 12, 2021, 8 pages.
Chinese Office Action with Search Report for Chinese Application No. 201780097449.6, dated Jan. 12, 2021, 8 pages.
International Preliminary Report on Patentability for International Application No. PCT/EP2017/082610, dated Jun. 16, 2020, 5 pages.
International Search Report and Written Opinion for International Application PCT/EP2017/082610, dated Aug. 21, 2018, 7 pages.
International Preliminary Report on Patentability for International Application No. PCT/EP2017/082615, dated Jun. 16, 2020, 7 pages.
International Preliminary Report on Patentability for International Application No. PCT/EP2017/082611, dated Jun. 16, 2020, 7 pages.
International Search Report and Written Opinion for International Application PCT/EP2017/082615, dated Aug. 9, 2018, 10 pages.
International Search Report and Written Opinion for International Application PCT/EP2017/082611, dated Aug. 9, 2018, 10 pages.
Chinese Office Action for Chinese Application No. 201780097456.6, dated Jan. 6, 2021, with translation, 19 pages.
Final Office Action for U.S. Appl. No. 16/771,111, mailed Apr. 19, 2022, 30 pages.
Notice of Allowance for U.S. Appl. No. 16/771,107, mailed Jul. 20, 2022, 9 pages.
Non Final Office Action for U.S. Appl. No. 16/771,111, mailed Sep. 8, 2022, 17 pages.

* cited by examiner

Fig. 9
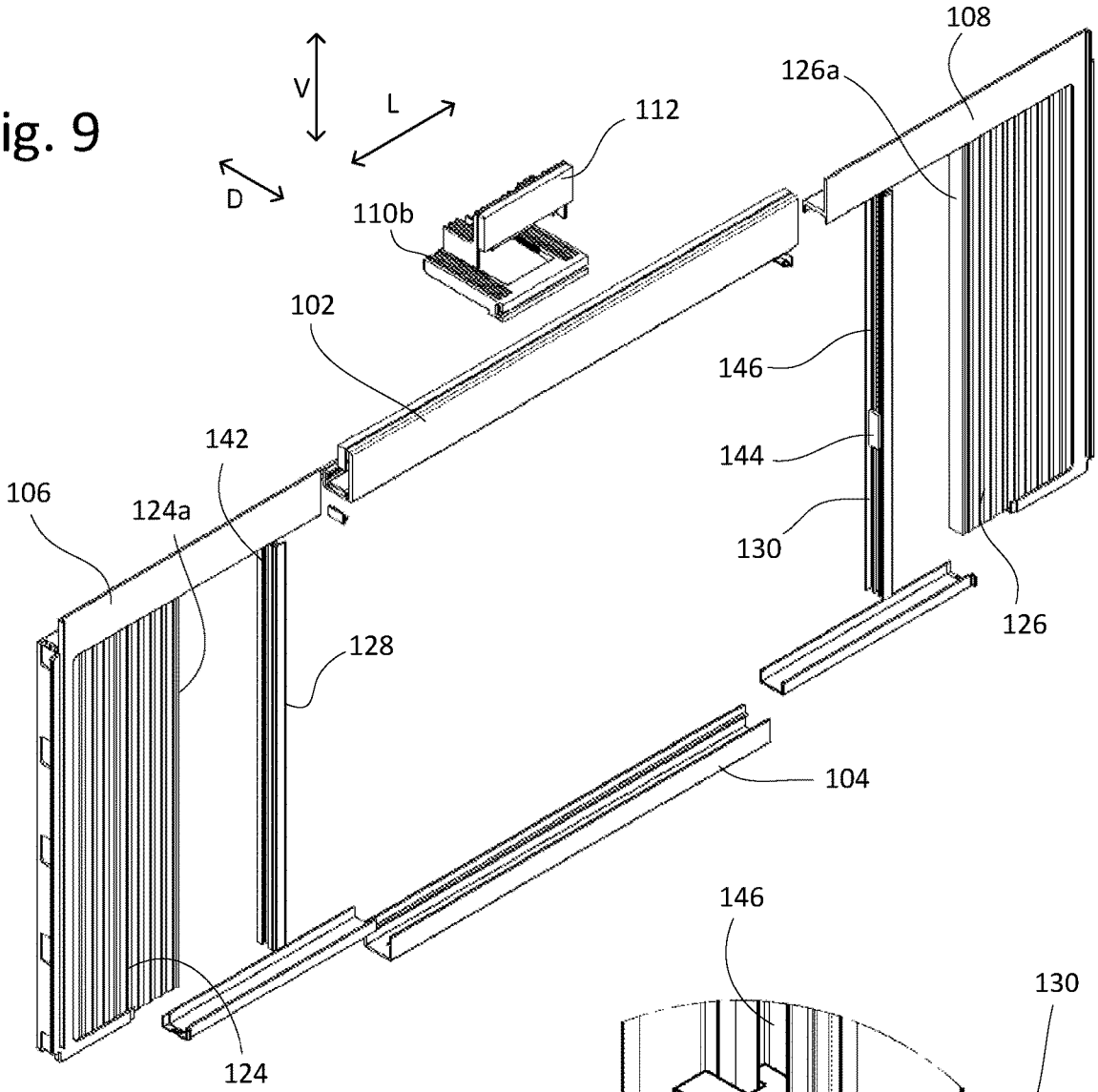
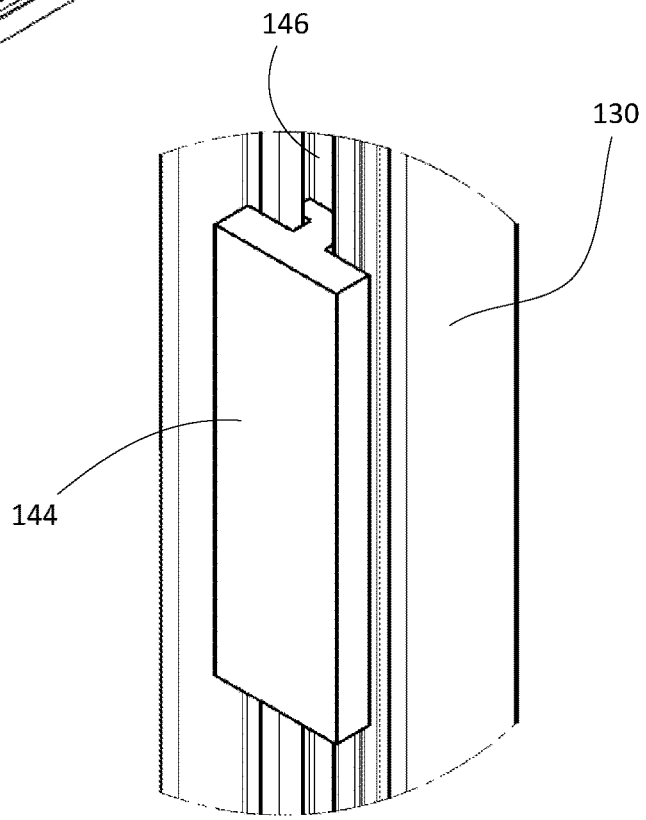
Fig. 10

WINDOW AIR CONDITIONING UNIT INSTALLATION SYSTEM

TECHNICAL FIELD

This application is directed to systems for attaching a window air conditioning unit to a window.

BACKGROUND

Air conditioning units are in common use to provide cooling to homes and other buildings. In some cases, the air conditioning unit is a permanent installation within the building, including airflow ducts and ventilation openings that pass through floors and walls to convey conditioned air. In other cases, the air conditioning unit is a non-permanent system that is installed into a pre-existing building, and operates separately from integrated airflow ducts and openings (if any) that are already present in the building. There are several varieties of non-permanent air conditioning units, including so-called "window units" that have their operating parts (compressor, evaporator, etc.) contained in one or more housings that are installed to extend through a window opening, and so-called "portable units" that have their operating parts in a housing that is placed inside a room.

In the case of window units, the air conditioner typically has a single housing containing a closed fluid circuit having a condenser, throttle (thermal expansion valve or capillary tube), evaporator, and compressor. The compressor receives cool gaseous refrigerant, pressurizes and heats the refrigerant, and conveys the heated refrigerant to the condenser. The heated refrigerant passes through the condenser, where a fan blows air over the condenser to remove heat. The refrigerant then passes through the throttle, which lowers the refrigerant pressure and temperature. The cooled refrigerant then passes through the evaporator, and another fan blows air over the evaporator to evacuate cooled air into the room being conditioned. The refrigerant then passes back to the compressor to continue the cycle.

A window air conditioning unit typically is installed directly in the window between the window sill and window sash. The unit's center of gravity usually is located outside the window, and the user interface (input controls and output displays) is located inside the window. The cold air outlet is also located inside the window, while the hot air exhaust is located outside the window. The weight of the unit outside the window, together with the window sash and sill, prevent the window unit from moving once it is installed.

A typical window air conditioning unit has a box-shaped housing with smooth sides. The unit may be provided with a window installation system that is attached by the installer to the sides of the unit, and the added structure of the window installation system can make it awkward to grip the unit for installation. A typical window unit is also heavy, and may not be suited for lifting without assistance. Thus, installing a window unit into a window can be a difficult and ergonomically challenging process, particularly for an single person. Furthermore, once the unit is in place in the window opening, the installer must use one hand to hold the unit and the other to close the window sash, which presents a falling hazard. In addition, once the sash is closed, the window installation system typically is secured to the window sash and/or frame using screws, which can void the window warranty.

Various window unit installation systems are known in the art.

U.S. Pat. No. 10,900,689 shows a window unit installation system that is secured to the window unit before installation to the window, and is intended to be installed without fasteners into the window frame or sash. This system is also intended to secure the window unit independently of the sash by providing an elongated bottom member and an elongated top member that both extend beyond the vertical side jambs of the window. However, this system does not provide any connection to the window that would prevent the window unit from being pulled inwards into the room, and appears to lack support necessary to prevent the bottom member from slipping into the room if the center of gravity of the window unit is located outside the window.

U.S. Pat. No. 10,520,206 shows another window unit installation system, in which side panels are telescopically attached to the window unit. This system is attached to the window unit prior to installation into the window, and appears to require screws to secure the installation system to both the window unit and the window.

U.S. Pat. No. 10,359,212 shows another window unit installation system, which has a clamp with an upward-facing channel to receive the window sash, and a downward-facing channel to receive a top rail of the window unit. The system uses thumbscrews to tighten the clamp onto to both the window unit and the window sash. The opposed upward-facing and downward-facing channels require the sash to be opened as the window unit is inserted into the window opening, and then slid down into the upward-facing channel.

While window unit installation systems are known in the art, there continues to be a need to advance the art of window air conditioning unit installation systems.

This description of the background is provided to assist with an understanding of the following explanations of exemplary embodiments, and is not an admission that any or all of this background information is necessarily prior art.

SUMMARY

In a first aspect, there is provided a window installation system for a window air conditioner, the window installation system comprising: a top rail extending in a longitudinal direction from a first top rail end to a second top rail end; a bottom rail extending in the longitudinal direction from a first bottom rail end to a second bottom rail end; a first vertical rail extending in a vertical direction that is perpendicular to the longitudinal direction, the first vertical rail having a respective top end configured to attach to the top rail at the first top rail end, and a respective bottom end configured to attach to the bottom rail at the first bottom rail end; a second vertical rail extending in the vertical direction, the second vertical rail having a respective top end configured to attach to the top rail at the second top rail end, and a respective bottom end configured to attach to the bottom rail at the second bottom rail end; a clamp fixture connected to the top rail; and a clamp having a clamp face, wherein the clamp is movably mounted on the clamp fixture between a first clamp position in which the clamp face is a first distance from the top rail in a depth direction that is perpendicular to the longitudinal direction and the vertical direction, and a second clamp position in which the clamp face is a second distance from the top rail in the depth direction.

In some aspects, the top rail, bottom rail, first vertical rail, second vertical rail and clamp are configured as separate parts that can be selectively assembled into a single assembly.

In some aspects, the top rail, bottom rail, first vertical rail and second vertical rail are configured to define, when connected together, an opening within the top rail, bottom rail, first vertical rail and second vertical rail, the opening being shaped and dimensioned to receive a window air conditioner therein.

In some aspects, the window installation system is configured to connect to window with the top rail secured to a window sash by the clamp, the bottom rail abutting a lower window sill, the first vertical rail abutting a first vertical window frame portion, and the second vertical rail abutting a second vertical window frame portion, and without a window air conditioner within the opening.

In some aspects, the window installation system is configured to receive a window air conditioner within the opening, and secure the air conditioning unit to the window without fasteners other than the clamp.

In some aspects, the clamp is located on a first side of the top rail with respect to the depth direction, and the opening is dimensioned to allow access to the clamp from a second side of the top rail, opposite the first side of the top rail, when no air conditioning unit is within the opening.

In some aspects, the respective top end of the first vertical rail is configured to slidingly connect to the top rail at the first top rail end, and the respective bottom end of the first vertical rail is configured to slidingly connect to the bottom rail at the first bottom rail end.

In some aspects, the respective top end of the second vertical rail is configured to slidingly connect to the top rail at the second top rail end, and the respective bottom end of the second vertical rail is configured to slidingly connect to the bottom rail at the second bottom rail end.

In some aspects, the first vertical rail comprises a respective vertical portion extending in the vertical direction, a respective top longitudinal portion extending in the longitudinal direction and telescopically connectable to the top rail, and a respective bottom longitudinal portion extending in the longitudinal direction and telescopically connectable to the bottom rail.

In some aspects, the bottom longitudinal portion comprises: a first bottom portion permanently fixed to the vertical portion and extending in the longitudinal direction from the vertical portion to a first bottom portion end; and a second bottom portion selectively connectable to the first bottom portion at the first bottom portion end, and extending in the longitudinal direction from the first bottom portion end to a second bottom portion end.

In some aspects, the window installation system further has a flexible panel connected to the vertical portion at a fixed edge and extending in the longitudinal direction to a free edge, wherein the flexible panel is extendable in the longitudinal direction to move the free edge towards the second vertical rail.

In some aspects, wherein the top longitudinal portion comprises a top channel facing the bottom longitudinal portion, and the bottom longitudinal portion comprises a bottom channel facing the top longitudinal portion, and the flexible panel is captured in the depth direction within the top channel and the bottom channel.

In some aspects, the window installation system further has a connector configured to selectively secure the free edge to a window air conditioner located between the free edge and the second vertical rail.

In some aspects, the window installation system further has at least one magnet located at the free edge.

In some aspects, the flexible panel comprises a folded panel or a flexible sheet mounted on a rotatable spindle.

In some aspects, the clamp fixture comprises a first portion fixed to the top rail, and a second portion selectively mountable to the first portion, and wherein the clamp is movably mounted to the second portion.

In some aspects, the first portion comprises a first track extending from first side of the closure plate in the depth direction, and the second portion comprises a second track configured to slide on the first track.

In some aspects, the second track is configured to slide on the first track in a sliding direction parallel to the longitudinal direction.

In some aspects, one of the first track and the track comprises an external T-track or L-track and the other of the first track and the second track comprises an internal T-track or L-track.

In some aspects, the clamp and the clamp fixture comprise interlocking parts configured to hold the clamp at the second clamp position.

In some aspects, the interlocking parts comprise a one-way ratchet.

BRIEF DESCRIPTION OF THE DRAWINGS

Embodiments will now be described, strictly by way of example, with reference to the accompanying drawings, in which:

FIG. 9 is an isometric exploded view of another embodiment of a window installation system.

FIG. 10 is a detail view of a portion of the illustration of FIG. 9.

Figure 1A:
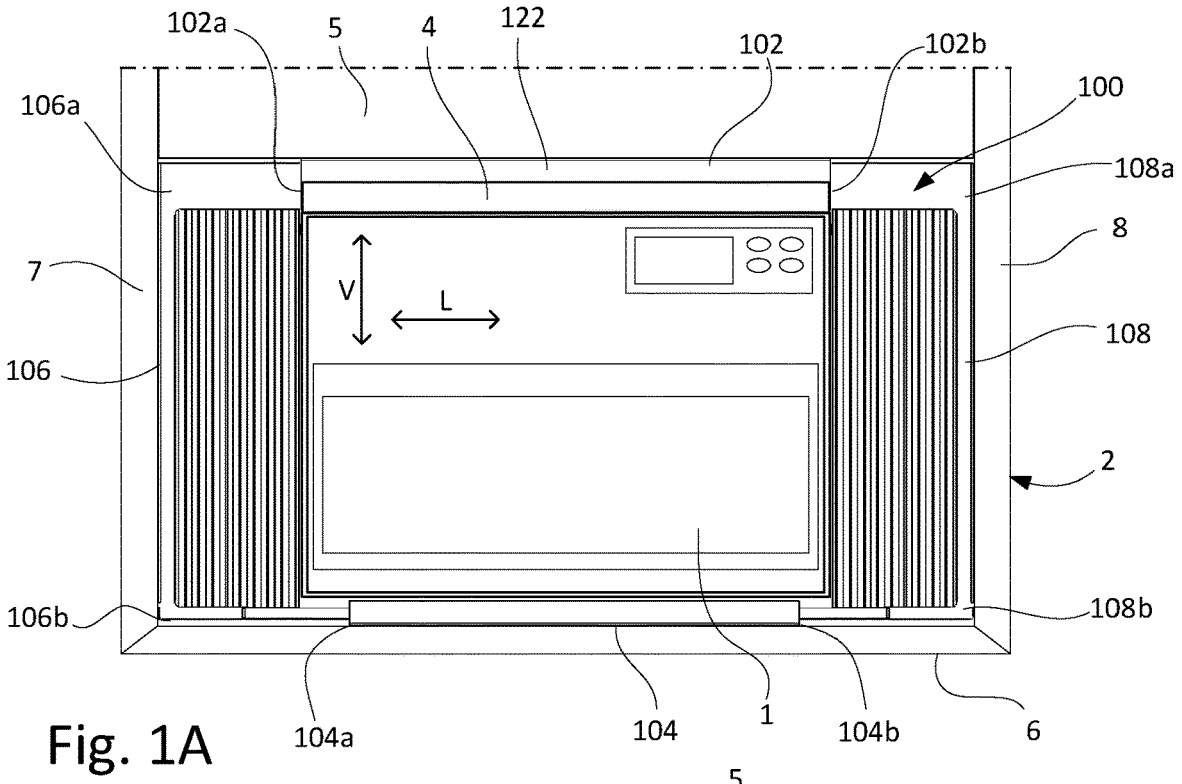
FIG. 1A is a front view of a window air conditioning unit installed into a window with a window installation system.

In the drawings, items identified by multiple reference numbers separated by commas represent alternative parts having the same structure.

DESCRIPTION OF EXEMPLARY EMBODIMENTS

Figure 1B:
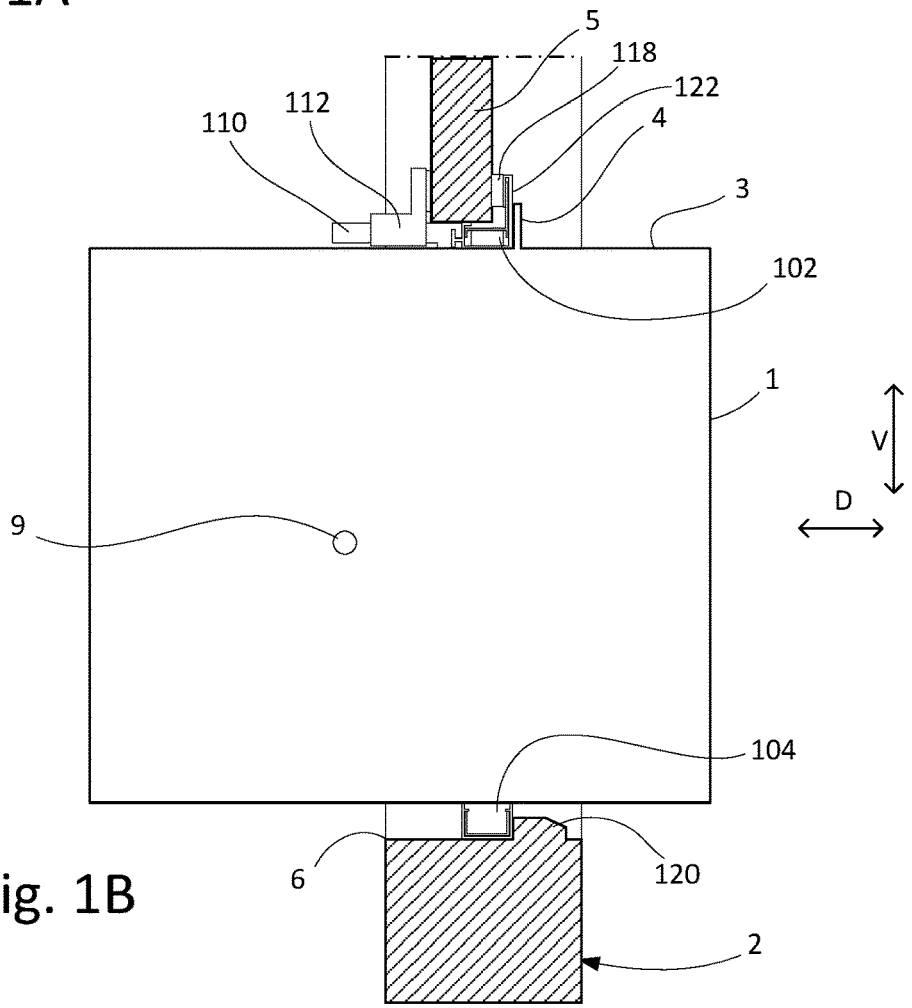
FIG. 1B is a cutaway side view of the window air conditioning unit installed into a window with a window installation system, as shown in FIG. 1A.

FIGS. 1A and 1B illustrate an example of a window installation system 100 mounting a window air conditioner 1 to a window 2. The window air conditioner 1 may have any suitable construction for providing cooled air to the room. For example, the window air conditioner 1 may have generally box-shaped housing 3 that contains a compressor, condenser, throttle (e.g., orifice plate, capillary tube, thermal expansion valve, etc.), and evaporator, as known in the art. The window air conditioner 1 may include integral or attached mounting features, such as a mounting flange 4 that extends from the housing 3. In this case, the mounting flange 4 extends from an upper wall of the housing 3, but it may extend around to the housing sidewalls.

Figure 2A:
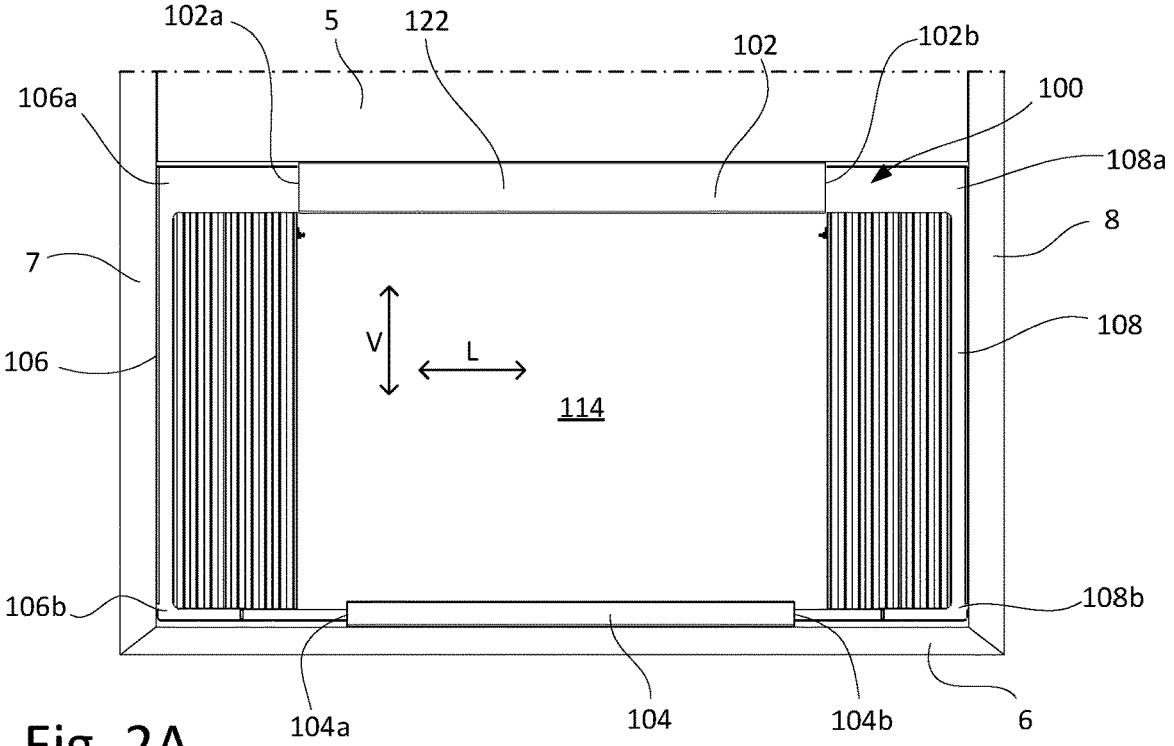
FIG. 2A is a front view of an installed window installation system without the window air conditioner in place.
Figure 2B:
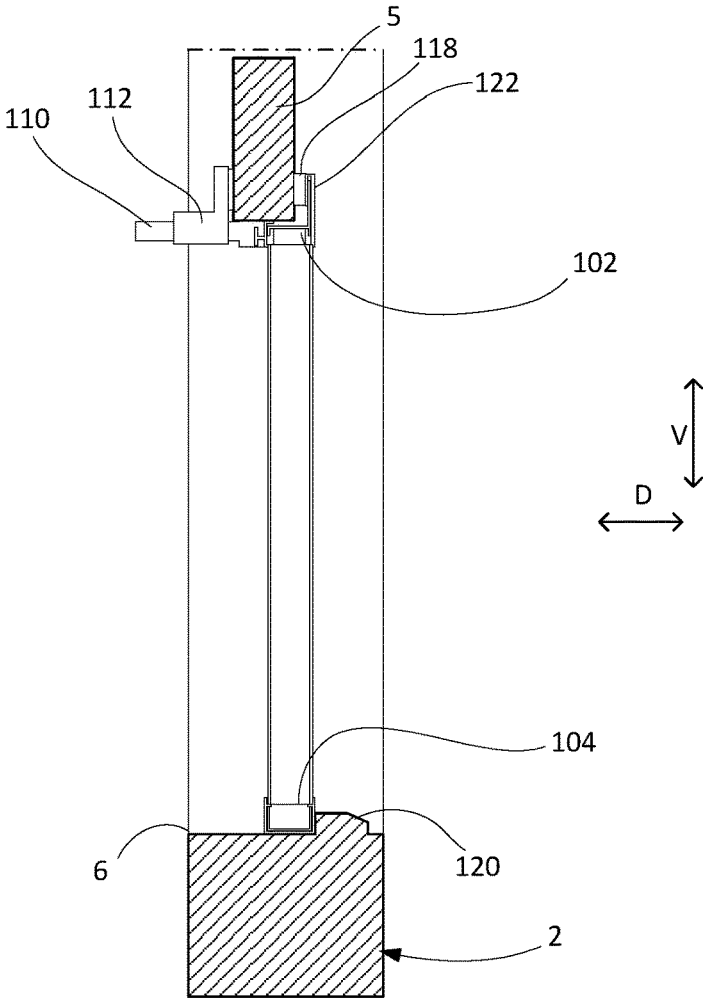
FIG. 2B is a cutaway side view of the installed window installation system, as shown in FIG. 2A.
Figure 3A:
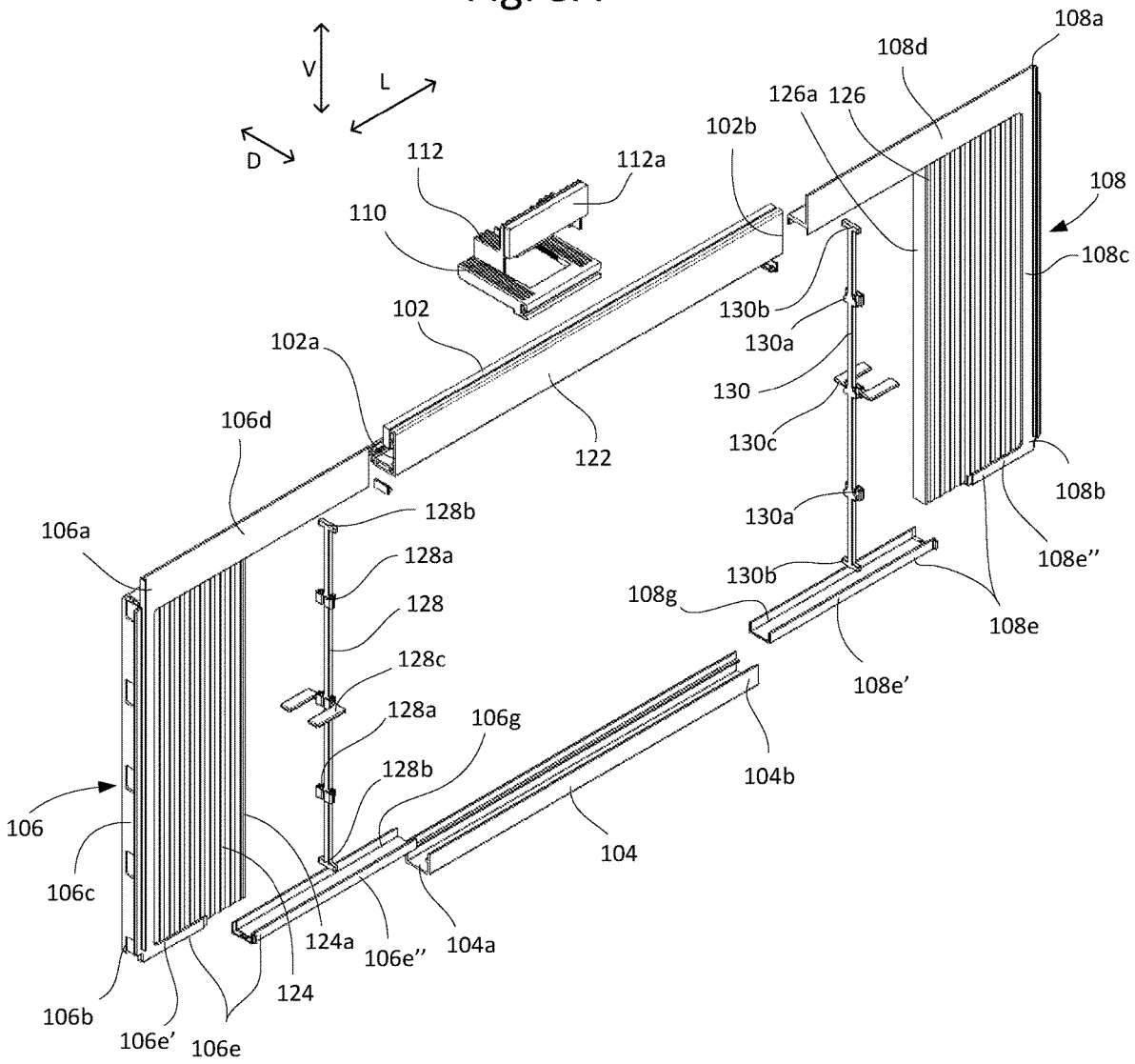
FIGS. 3A and 3B are exploded isometric and front views, respectively, of an example of a window installation system.
Figure 3B:
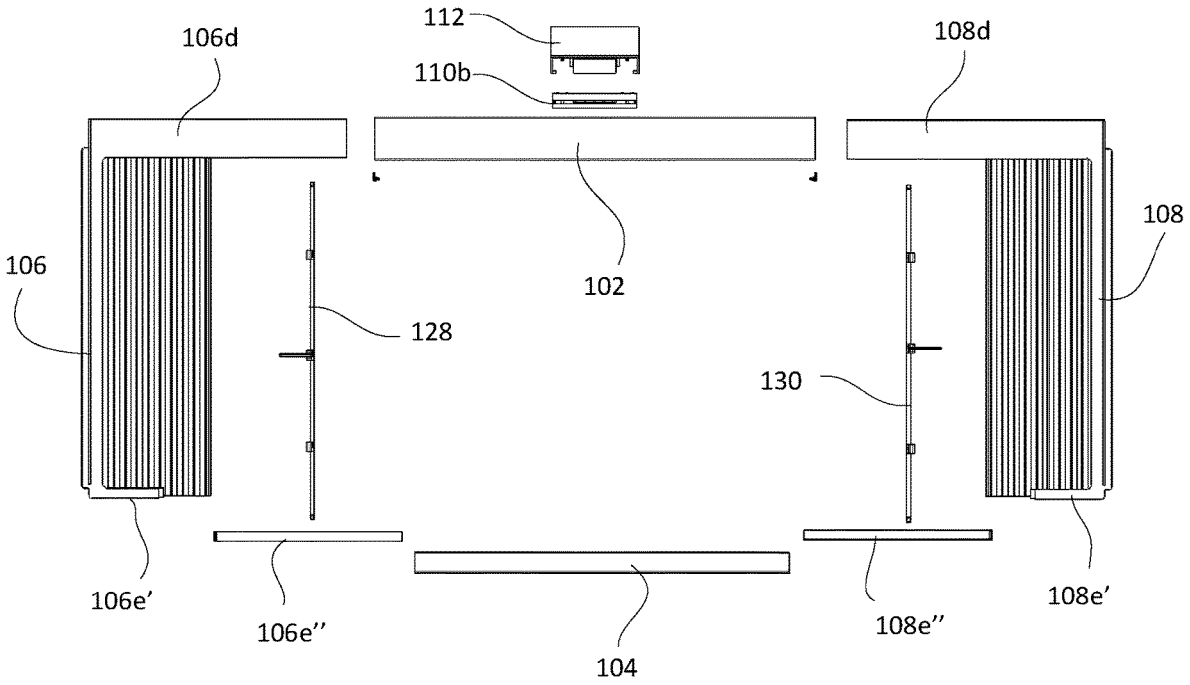

FIGS. 2A and 2B show the window installation system 100 installed in in the window 2 prior to inserting the window air conditioner 1. The window installation system 100 generally includes a top rail 102, a bottom rail 104, a first vertical rail 106, a second vertical rail 108, a clamp fixture 110 and a clamp 112.

The top rail 102 extends in a longitudinal direction L from a first top rail end 102*a* end to a second top rail end 102*b*. The bottom rail 104 extends in the longitudinal direction L from a first bottom rail end 104*a* to a second bottom rail end 104*b*. The first vertical rail 106 extends in a vertical direction V, which is perpendicular to the longitudinal direction L, from a first vertical rail top end 106*a* to a first vertical rail bottom end 106*b*. The second vertical rail 108 extends in the vertical direction V from a second vertical rail top end 108*a* to a second vertical rail bottom end 108*b*. The top end 106*a* of the first vertical rail 106 is configured to connect to the first top rail end 102*a*, and the bottom end 106*b* of the first vertical rail 106 is configured to connect to the first bottom rail end 104*a*. Similarly, the top end 108*a* of the second vertical rail 108 is configured to connect to the second top rail end 102*b*, and the bottom end 108*b* of the second vertical rail 108 is configured to connect to the second bottom rail end 104*b*. Thus, the top rail 102, bottom rail 104, first vertical rail 106 and second vertical rail 108 form a generally rectangular or square structure, that surrounds an opening 114.

The clamp fixture 110 and clamp 112 are connected to a first side 116 of the top rail, in relation to a depth direction D that extends perpendicular to the longitudinal direction L and the vertical direction D. The clamp 112 has a clamp face 112*a* that faces an adjacent portion of the top rail 102, to form a space therebetween. The clamp 112 is mounted to the clamp fixture 110 such that the clamp can move between a first clamp position in which a clamp face 112*a* is a first distance D1 from the top rail 102 in the depth direction D (FIG. 4), and a second clamp position in which the clamp face 112*a* is a second distance D2 from the top rail 102 in the depth direction D (FIG. 5).

The top rail 102, bottom rail 104, first vertical rail 106, second vertical rail 108 and clamp 112 may be provided as separate parts of an installation kit, with instructions directing the user how to assemble them together. This may provide a more convenient package size for shipping and sale of the window installation system. Alternatively, some of all of the parts may be permanently affixed to each other (i.e., fixed in a way that would require destruction of parts, or of fasteners holding the parts together, to separate the parts from each other).

As shown in FIGS. 2A and 2B, the window installation system 100 can be attached to a window 2 with the top rail 102 abutting the window sash 5, the bottom rail 104 abutting a lower window sill 6, the first vertical rail 106 abutting a first vertical window frame portion 7, and the second vertical rail 108 abutting a second vertical window frame portion 8. The sash 5 is captured between the clamp face 112*a* and the top rail 102 to provide an upper fixation point. The sash 5 may be pressed downward to generate a preload force on the top rail 102, but this is not required. One or more seals 118 may be provided to help the window installation system 100 grip the window 2 and/or help ensure an air seal between the window 2 and the window installation system 100.

In some embodiments, the clamp 112 is the only mechanical connection between the window installation system 100 and the window 2. The remaining retention forces being are provided by simple friction between various parts, as might be generated by pressing the sash 5 down on the top rail 102, or by contact between the window installation system 100 and contours of the window, such as contact between the bottom rail 104 and a window sill ledge 120. The absence of any invasive mechanical connectors (e.g. screws or the like that require modification of the underlying surface to provide attachment) helps facilitate installation, avoids damage to the window, and avoids possible voiding of the window warranty. However, it will be understood that some users may nevertheless elect to add invasive mechanical fasteners as a second layer of protection, or where damage to the window is not a concern (e.g., windows that were previously damaged by prior installations).

The window installation system 100 preferably can be securely and fully installed into the window 2 before the window air conditioner 1 is installed into the opening 114. For example, in the embodiment of FIGS. 1A and 1B, the window air conditioner 1 is installed in the opening 114 to rest on the bottom rail 104, with an existing mounting flange 4 resting against an interior surface 122 of the upper rail 102. The center of gravity 9 of the window air conditioner 1 is located on the side opposite the interior surface 122, and thus gravity holds the window air conditioner 1 in place within the opening 114.

This configuration provides a significant advantage over window installation systems that are attached to the window air conditioning unit before the assembly is installed in the window. For example, this avoids having to hold the assembly in place while lowering the sash 5. Furthermore, with the installation system attached, the window air conditioner can become difficult to handle and cumbersome to move, and so prior assembly of the window installation system 100 to the window eases this burden on the installer.

While it is preferable to install the entire window installation system 100 in the window 2 before installing the window air conditioner 1, some embodiments may include additional parts that are attached to the window air conditioner 1 to enable the window air conditioner 1 to properly fit into the opening 114. For example, if a mounting flange 4 is not provided on the housing 3, a separate mounting flange 4 may be provided for attaching to the housing 3. A variety of flanges 4 or flange extension plates having different heights in the vertical direction V also may be provided to allow the installer to select an appropriate flange for the particular window air conditioner 1 being installed. Other alternatives and variations will be apparent to persons of ordinary skill in the art in view of the present disclosure.

FIGS. 3A-7 illustrate an example of a window installation system 100 in more detail. In this example, the top rail 102 and bottom rail 104 each has a generally linear shape extending in the longitudinal direction L, and the first and second vertical rails 106, 108 are configured to slidingly connect to the top rail 102 and bottom rail 104, to thereby allow adjustment of the total length of the window installation system 100 in the longitudinal direction L. Any suitable sliding connection may be used. For example, in the shown case, the first vertical rail 106 has a vertical portion 106*c* extending in the vertical direction V, a top longitudinal portion 106*d* extending in the longitudinal direction L from the top end 106*a*, and a bottom longitudinal portion 106*e* extending in the longitudinal direction L from the bottom end 106*b*. The top longitudinal portion 106*d* is telescopically received in the top rail 102 at the first top rail end 102*a*, and the bottom longitudinal portion 106*e* is telescopically received in the bottom rail 104 at the first bottom rail end 104*a*. Similarly, the second vertical rail 108 has a vertical portion 108*c* extending in the vertical direction V, a top longitudinal portion 108*d* extending in the longitudinal direction L from the top end 108*a*, and a bottom longitudinal portion 108*e* extending in the longitudinal direction L from the bottom end 108*b*. The top longitudinal portion 108*d* of the second vertical rail 108 is telescopically received in the top rail 102 at the second top rail end 102*a*, and the bottom longitudinal portion 108*e* is telescopically received in the bottom rail 104 at the second bottom rail end 104*b*.

Figure 4:
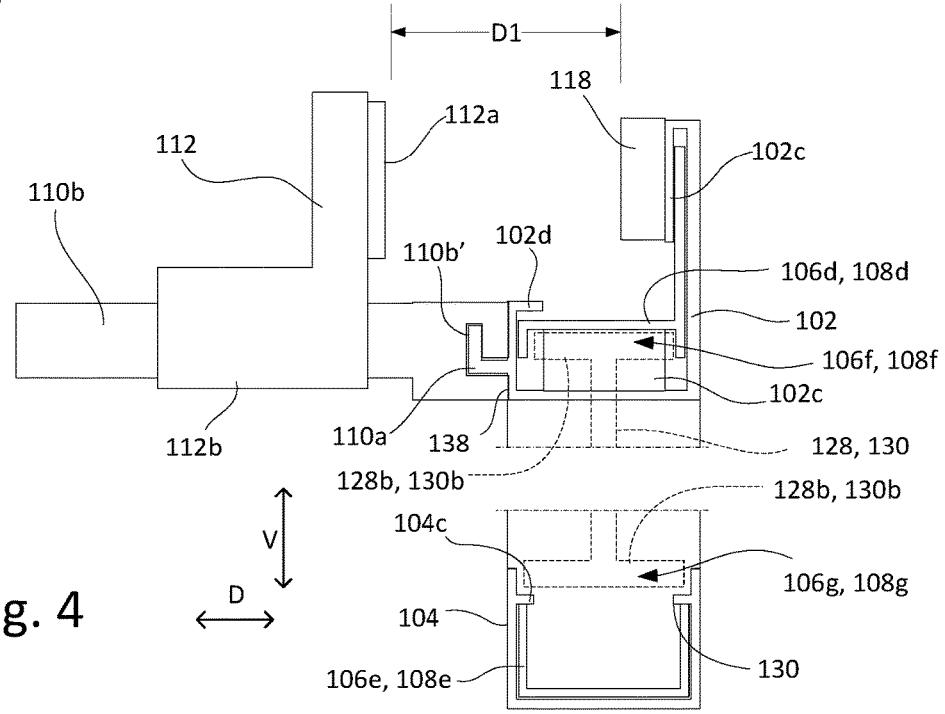
FIG. 4 is a side view of the window installation system of FIGS. 3A and 3B.
Figure 5:
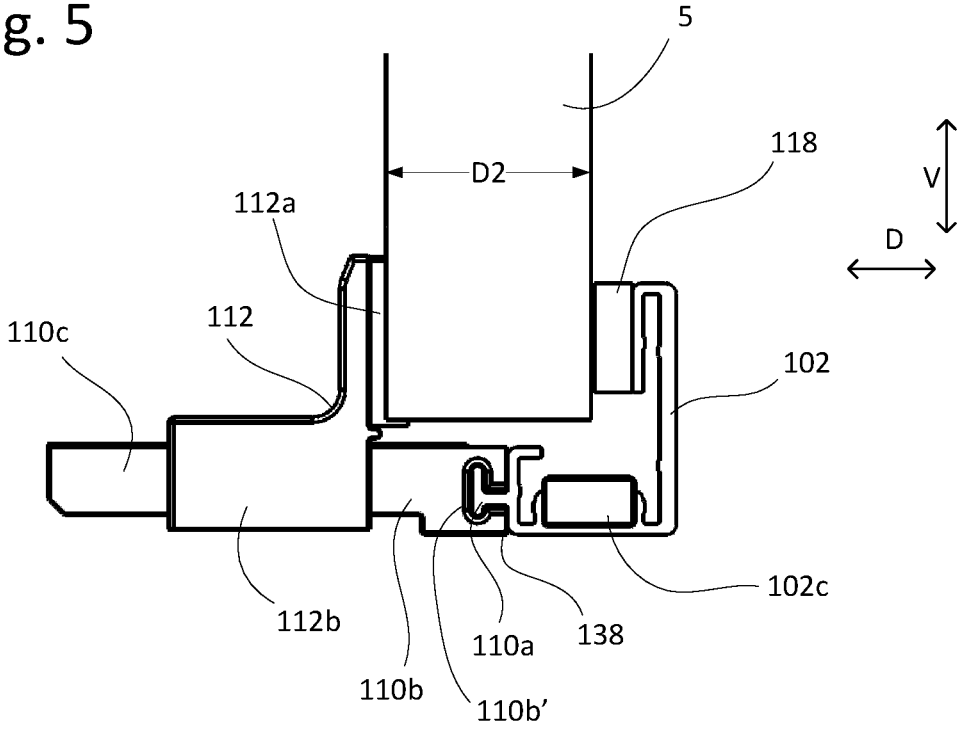
FIG. 5 is a partial side view of the window installation system of FIGS. 3A and 3B, shown attached to a window sash.
Figure 6:
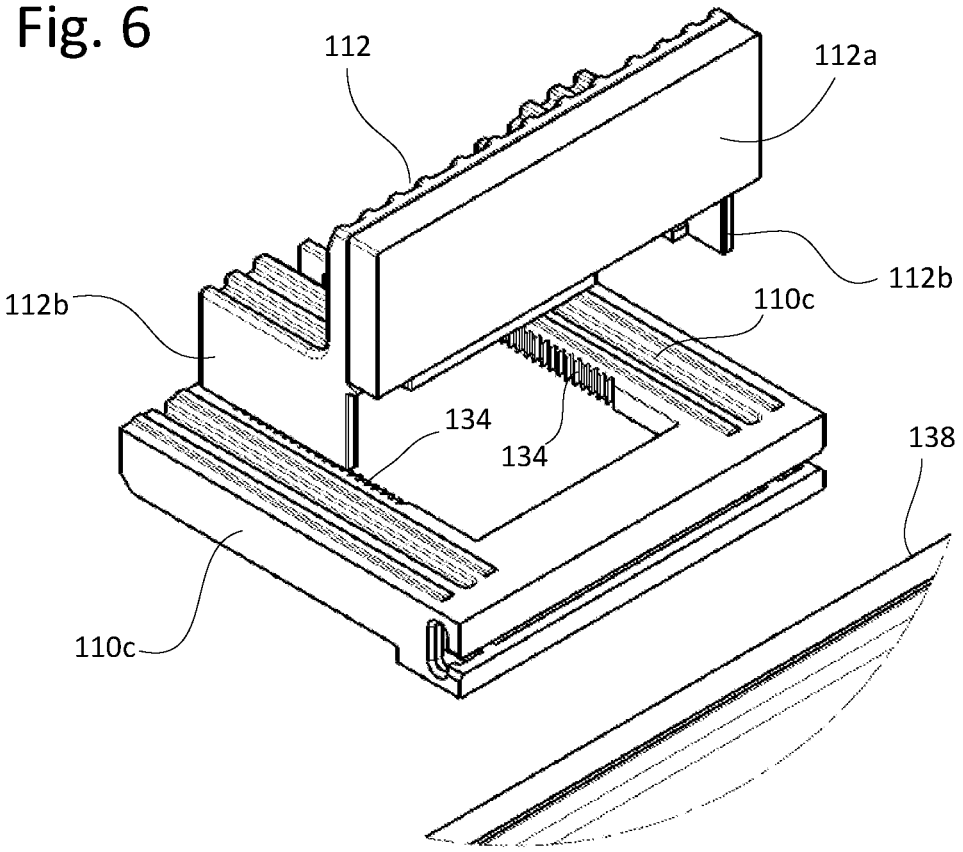
FIG. 6 is a front exploded isometric view of a clamp and clamp fixture that may be used with the embodiment of FIGS. 3A and 3B.
Figure 7:
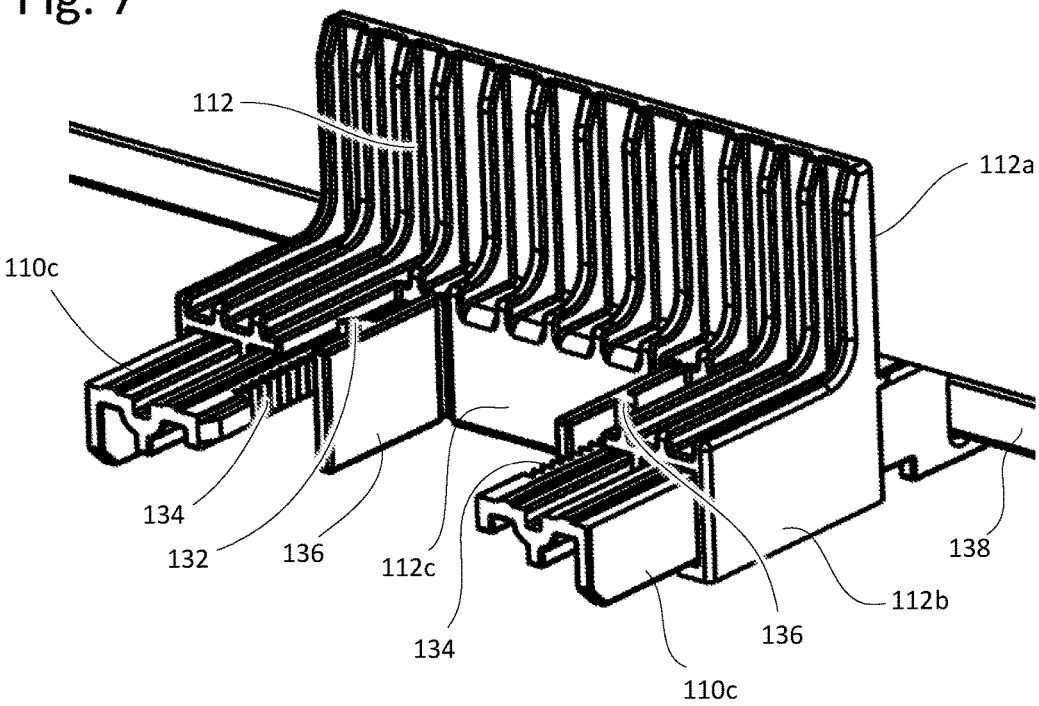
FIG. 7 is a rear assembled view of the clamp and clamp fixture of FIG. 6.

FIG. 4 shows exemplary shapes for the top rail 102, bottom rail 104, top longitudinal portions 106*d*, 108*d* and bottom longitudinal portions 106*e*, 108*e*. In this case, the top rail 102 has a generally L-shaped profile as viewed along the longitudinal direction L, and the top longitudinal portions 106*d*, 108*d* are shaped to nest within the top rail profile. The top rail profile includes a first lip 104*c* that surrounds the upper end of the top longitudinal portions 106*d*, 108*d*, and a second lip 104*d* that surrounds a lower end of the top longitudinal portions 106*d*, 108*d*. Thus, the top longitudinal portions 106*d*, 108*d* are captured against movement in the depth direction D and vertical direction V, and can only slide along the longitudinal direction L.

The bottom rail 104 has a C-shaped profile, with the opening facing upwards towards the top rail 102. The bottom longitudinal portions 106*e*, 108*e* of the vertical rails 106, 108 nest within the C-shaped bottom rail profile. The bottom rail profile 104 also includes protrusions 130 that hold the bottom longitudinal portions 106*e*, 108*e* in the vertical direction. Thus, the bottom longitudinal portions 106*e*, 108*e* are captured against movement in the depth direction D and vertical direction V, and can only slide along the longitudinal direction L.

The top rail 102, bottom rail 104, top longitudinal portions 106*d*, 108*d*, and bottom longitudinal portions 106*e*, 108*e* may be formed in any suitable manner. For example, they may be formed as aluminum or plastic extrusions, as folded sheetmetal profiles, as cast parts, and so on. The profile shapes also may be modified in various ways while still providing relative sliding along the longitudinal direction. Other alternatives and variations will be apparent to persons of ordinary skill in the art in view of the present disclosure.

If desired, mechanisms may be provided to selectively hold the first vertical rail 106 and second vertical rail 108 at particular locations along the longitudinal direction L with respect to the top rail 102 and/or bottom rail 104. For example, the top rail 102 can include one or more friction pads 102*c* (FIGS. 4 and 5), such as a rubber or elastomeric pad, that interferes slightly with the top longitudinal portions 106*a*, 108*a* to hold them by friction at a desired state of extension in the longitudinal direction L. In other cases, a separate clamp may be used. In still other cases, the first vertical rail 106 and second vertical rail 108 may be held in the longitudinal direction by friction generated by pressing the window sash 5 down on them. Other embodiments may use other mechanism, or such mechanisms can be omitted.

One or both of the top longitudinal portions 106*d*, 108*d* and the bottom longitudinal portions 106*e*, 108*e* may be formed from multiple parts. In the shown example, bottom longitudinal portion 106*e* is formed by a first bottom portion 106*e*' and a second bottom portion 106*e*". The first bottom portion 106*e*' is permanently fixed to the vertical portion 106*c*, and extends in the longitudinal direction L to a first bottom portion end. The second bottom portion 106*e*" is connected to the end of the first bottom portion 106*e*', and extends therefrom in the longitudinal direction L to a second bottom portion end. The two bottom portions 106*e*', 106*e*" may be connected by a snap fitting or the like. The second bottom longitudinal portion 108*e* may have a similar construction with a first bottom portion 108*e*' and a second bottom portion 108*e*". In operation, the second bottom portions 106*e*" 108*e*" are telescopically inserted into the bottom rail 104. The first bottom portions 106*e*', 108*e*' also may be dimensioned to slide into the bottom rail 104.

Forming the bottom longitudinal portions 106*e*, 108*e* from multiple parts can provide certain benefits. For example, with wider window air conditioners 1 (or narrower window openings) the first bottom portions 106*e*', 108*e*' may be inserted directly in the bottom rail 104, without using the second bottom portions 106*e*", 108*e*", whereas with narrower window air conditioners 1 (or wider window openings) the second bottom portions 106*e*", 108*e*" can be added to connect the first bottom portions 106*e*', 108*e*' to bottom rail 104 to form an air barrier and form a secure structural connection to hold the first and second vertical rails 106, 108 relative to the window air conditioner 1. The parts can also be adjusted or replaced to fit a variety of different window air conditioners. Also, if the installer chooses to attach the bottom rail 104 to the sill 6 with invasive fasteners or adhesives (e.g., a foaming adhesive to provide an improved air seal), the first bottom portions 106*e*', 108*e*' can be separated from the second bottom portions 106*e*", 108*e*" to allow the remainder of the window installation system 100 to be removed while the bottom rail 102 and second bottom portions 106*e*", 108*e*" remain in place.

The window installation system 100 also may include or be modified to include mechanisms to form a seal between the first and second vertical rails 106, 108 and the window air conditioner 1. A simple foam seal or the like may be used, and, if necessary a spacer or closed panel may be provided to extend between one or both of the first and second vertical rails 106, 108 and the window air conditioner 1. Such a spacer or panel can be fabricated at the installation side (e.g. by cutting a plastic panel of the like). More preferably, the window installation system 100 has a first flexible panel 124 extending from the first vertical rail 106, and a second flexible panel 126 extending from the second vertical rail 108. Each flexible panel 124, 126 can be extended in the longitudinal direction L to contact the window air conditioner 1, and thereby close the open space that might otherwise exist. The flexible panels 124, 126 may have any suitable extendable construction. In the shown example, each flexible panel 124, 126 is a flexible plastic sheet that is folded in alternating directions as multiple locations to form an accordion-type expandable panel, as known in the art. On other cases, the flexible panels 124, 126 may comprise overlapping rigid panels that slide relative to each other, flexible sheets provided on spindles and that can be unspooled to a desired length (see, e.g., FIG. 11), and so on. Other alternatives and variations will be apparent to persons of ordinary skill in the art in view of the present disclosure.

The exemplary flexible panels 124, 126 are permanently secured to the vertical rails 106, 108 by adhesive, snap fittings, fasteners, or the like. Each flexible panel 124, 126 extends to a respective free end 124*a*, 126*a* that is movable in the longitudinal direction L to engage the window air conditioner 1. The free ends 124*a*, 126*a* may be secured to the window air conditioner 1 using any suitable connection. In the shown example, a first connector 128 is provided to secure the free end 124*a* of the first flexible panel 124 to one side of the window air conditioner 1, and a second connector 130 is provided to secure the free end 126*a* of the second flexible panel 126 to an opposite side of the window air conditioner 1. Each connector 128, 130 has clips 128*a*, 130*a* that grip the respective free panel end 124*a*, 126*a*, and T-shaped ends 128*b*, 130*b* that slide along the top longitudinal portions 106*d*, 108*d* and bottom longitudinal portions 106*e*, 108*e* of the respective vertical rail 106, 108. Each connector 128, 130 also may have a handle 128*c*, 130*c* for adjusting the position of the respective flexible panel 124, 126.

The T-shaped ends 128*b*, 130*b* are dimensioned to fit into top channels 106*f*, 108*f* formed in the top longitudinal portions 106*d*, 108*d*, and bottom channels 106*g* formed in the bottom longitudinal portions 106*e*, 108*e* (see FIG. 4). The top channels 106*f*, 108*f* are open to face the bottom longitudinal portions 106*e*, 108*e*, and the bottom channels 106*g*, 108*g* are open to face the top longitudinal portions 106*d*, 108*d*. Thus, the T-shaped ends 128*b*, 130*b*—and thus the flexible panels 124, 126—are captured in place in the vertical direction V and the depth direction D, while allowing sliding movement in the longitudinal direction L.

The connectors 128, 130 may be held in position against the sides of the window air conditioner 1 by friction between the T-shaped ends 128*b*, 130*b* and the top longitudinal portions 106*d*, 108*d* and bottom longitudinal portions 106*e*, 108*e* of the respective vertical rail 106, 108. For example, the T-shaped ends 128*b*, 130*b* may be slightly oversized within channels or tracks formed in the top longitudinal portions 106*d*, 108*d* and bottom longitudinal portions 106*e*, 108*e*. In other cases, the connectors 128, 130 may be secured by fasteners or adhesive (e.g., a double-sided foam sealing tape) to the window air conditioner 1. Other alternatives and variations will be apparent to persons of ordinary skill in the art in view of the present disclosure.

Details of an exemplary clamp fixture 110 and clamp 112 are shown in FIGS. 4-7. The clamp fixture 110 has a first portion 110a and a second portion 110b. The first portion 110a is fixed to the top rail 102, such as by integrally forming the first portion 110a as part of an extrusion that forms the remainder of the top rail 102, or by other means (e.g., bonding, welding, rivets, etc.). The second portion 110b is configured to selectively mount on the first portion 110a. For example, the second portion 110b may be secured to the first portion 110a by removable fasteners such as screws or snap fittings. Providing the second portion 110b as a separate part that can be attached to the first part 110*a* can allow the parts to be shipped as separate components in a relatively small package, or allow selective choice of different clamp mechanisms depending on the particular installation requirements.

In the shown example, the first portion 110a is formed as a first L-shaped exterior track, and the second portion 110b has a corresponding L-shaped interior track 110*b*' that slides on the exterior track (i.e., matching L-tracks). The tracks are oriented to allow sliding movement in the longitudinal direction L, but other sliding directions may be used. It will be appreciated that the L-shaped tracks may be replaced by other shapes. For instance, the crossbar of the "L" can be replaced with a circular profile to provide a track having a "lollipop" shape. As another example, the exterior and interior L-tracks may be replaced by exterior and interior T-shaped tracks 110*a*, 110*b*' (i.e., matching T-tracks), as shown in FIG. 5. The second portion 110b may be configured to secure at a particular location in the longitudinal direction L along the first portion 110a (e.g., by snap detents that indicate a position centered on the top rail 102), but this is not strictly required. It will also be appreciated that the clamp fixture 110 may comprise a single unitary part that is permanently attached to the top rail 102.

As noted above, the clamp 112 is movably mounted on the clamp fixture 110. For example, the clamp 112 may be mounted to slide along the clamp fixture 110b in a direction parallel to the depth direction D. In the shown example, the clamp fixture 110 has posts 110*c* that extend in the depth direction D, and clamp 112 has channels 112*b* that wrap around respective posts 110*c* to capture the clamp 112 against movement in the longitudinal direction L and vertical direction V, but allow sliding in the depth direction D.

The clamp 112 optionally may be provided as a separate part that is selectively secured to the clamp fixture 110. For example, the shown clamp 112 can be installed on the clamp fixture 110 by sliding it from the ends of the posts 110*c* towards the top rail 102. If the clamp fixture 110 includes a separate second part 110*b*, the clamp 112 may be installed on the second part 110*b* before the second part 110*b* is attached to the first part 110*a*.

The clamp 112 is configured to be selectively secured to the clamp fixture 110 at one or more locations along the depth direction D, to thereby clamp a sash 5 between the clamp face 112*a* and the top rail 102. In the shown example, the clamp 112 and the clamp fixture 110 have interlocking parts configured to hold the clamp 112 at the second clamp position. These interlocking parts may be formed as one or more first ribs 132 on the clamp 112, which engage one or more second ribs 134 on the clamp fixture 110. The first ribs 132 and second ribs 134 extend perpendicular to the depth direction D (or whatever direction the clamp 112 moves in to clamp against the window sash or the like). The first ribs 132 and second ribs 134 are positioned to overlap each other along the depth direction D. Thus, one or both of the first ribs 132 and the second ribs 134 must be displaced in a direction perpendicular to the depth direction D to allow free movement of the clamp 112 relative to the clamp fixture 110.

Selective displacement of the first ribs 132 relative to the second ribs 134 may be provided by mounting one or both of the first ribs 132 and the second ribs 134 on flexible arms 136. In this example, the first ribs 132 are mounted on flexible arms 136, and the flexible arms 136 may be displaced manually by the user (e.g., by squeezing the free ends of the arms 136 together) to disengage the first ribs 132 from the second ribs 134 and allow free movement of the clamp 112 relative to the clamp fixture 110 in the depth direction D. The arms 136 also may be displaced by interaction between the first ribs 132 and the second ribs 134. For example, the first ribs 132 and/or the second ribs 134 may have tapered faces that face each other as the clamp 112 moves towards the second clamp position. The tapered faces act as wedges to drive the flexible arms 136 perpendicular to the depth direction D as a force is applied to move the clamp 112 along the depth direction D. Thus, the first ribs 132 and second ribs 134 can act as a one-way ratchet that allows the clamp 112 to be moved towards the second clamp position without having to manually release the first ribs 132 from the second ribs 134, while preventing movement of the clamp 112 towards the first clamp position until the user manually disengages the first ribs 132 from the second ribs 134. This one-way ratchet arrangement is expected to be particularly useful to allow relatively easy engagement of the clamp 112 with the window sash 5.

Further examples of clamp fixtures 110 and clamps 112 are described in U.S. application Ser. No. 17/558,962, entitled "Portable Air Conditioning Unit Window Installation System, which is incorporated by reference in its entirety.

The clamp 112 also may be configured to be readily operated by accessing it through the opening 114 formed by the window mounting system 110. In this example, the clamp 112 is mounted on an outer side 138 of the top rail 102 with respect to the depth direction D, and the opening 114 is dimensioned to allow access to the clamp 112 from the opposite side of the top rail 102 when the window air conditioner is not installed. The clamp 112 also may include a handle portion 112c that faces away from the opening 114 and is shaped and positioned to receive one or more fingers of the hand. In some cases, access to the clamp 112 may be possible with the window air conditioner 1 in place by sliding one of the flexible panels 124, 126 away from the window air conditioner 1 and reaching around the top of the window air conditioner 1.

Figure 8:
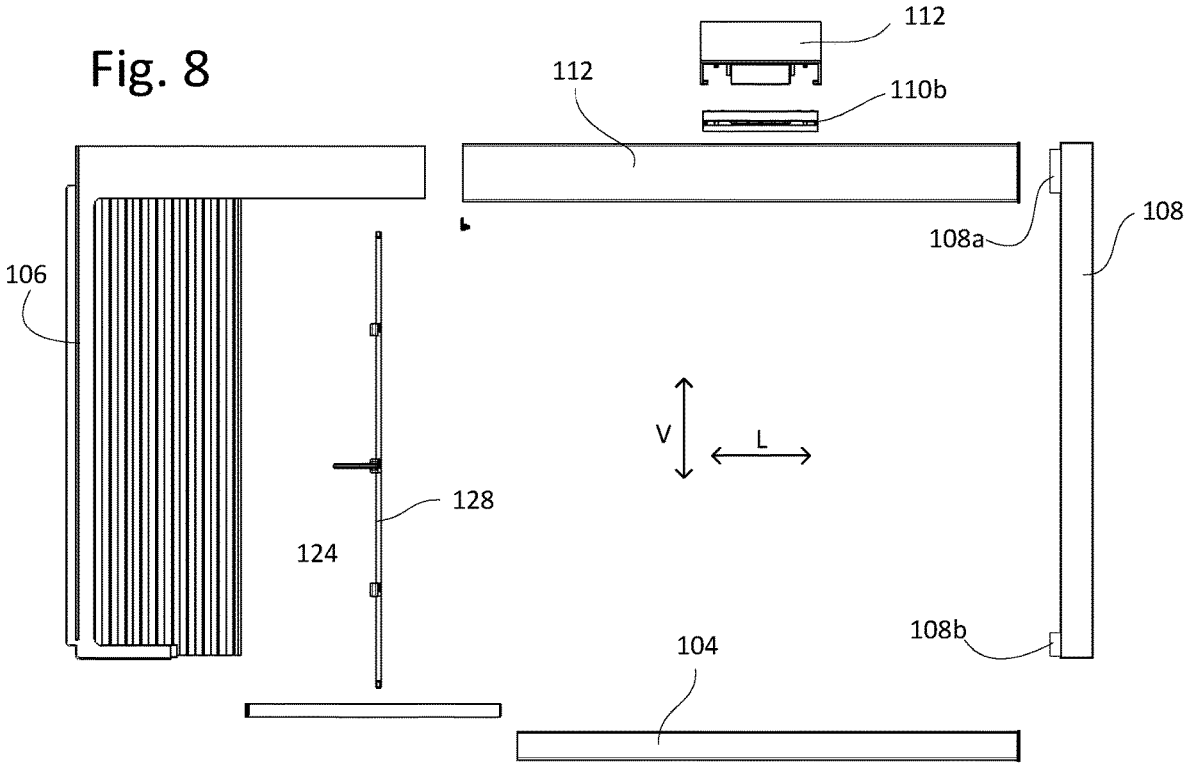
FIG. 8 is a front exploded view of another embodiment of a window installation system.

FIG. 8 illustrates another example of a window installation system 100. This window installation system 100 is generally the same as the one described in relation to FIGS. 3A-7, however, the telescopically-mounted second vertical rail 108 lacks features to allow telescopic repositioning along the length direction L. Instead, the second vertical rail 108 is secured to the top rail 102 and bottom rail 104 by a top fitting 140*a* and a bottom fitting 140*b* that provide a rigid, non-movable connection. In this case, the window installation system 100 is only telescopically adjustable on one side. The window installation system 100 also may omit a second expandable panel 126, or one may be provided in case the window air conditioner 1 cannot be positioned immediately adjacent to the second vertical rail 108.

In still other embodiments, both the first vertical rail 106 and the second vertical rail 108 may also be constructed as non-telescoping members. In addition, the window installation system 100 may be provide with both telescoping and non-telescoping vertical members 106, 108, to allow the installer to decide which vertical members 106, 108 to use at the time of installation. Other alternatives and variations will be apparent to persons of ordinary skill in the art in view of the present disclosure.

FIGS. 9 and 10 show another embodiment of a window installation system 100. This embodiment is generally the same as the embodiment of FIGS. 3A-7, with the difference being in the construction of the connectors 128, 130. In this case, the connectors 128, 130 are secured to the respective free end 124*a*, 126*a* by sliding the free end 124*a*, 126*a* into a first channel 142 located on one side of the connector 128, 130. On the other side, each connector 128, 130 has one or more magnets 144 that face the window air conditioner 1. The magnets 144 are secured to the rest of the connector 124, 126 by sliding engagement with a second channel 146, but other connections may be used.

Figure 11:
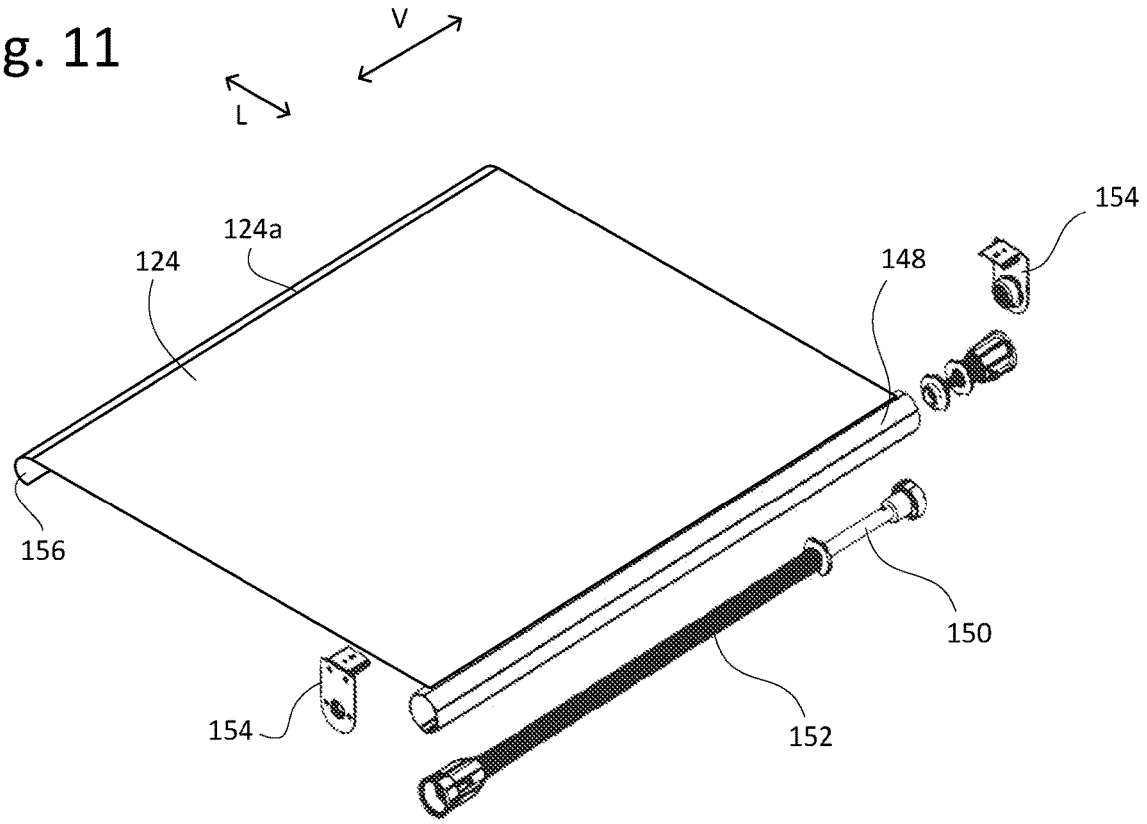
FIG. 11 is an exploded isometric view of another example of a flexible panel that may be used with embodiments.

FIG. 11 shows another example of a flexible panel 124 having a window-shade type construction. The flexible panel 124 is mounted on a spindle 148, which is rotatably connected to a spindle shaft 150. A torsion spring 152 interconnects the spindle 148 and spindle shaft 150, such that the torsion spring 152 is extended by unrolling the flexible panel 124, and relaxed by rolling the flexible panel onto the spindle 148. The ends of the spindle shaft 150 are secured to a vertical rail 106, 108 by connectors 154 to hold the flexible panel 124 at that location. The free end 124*a* of the flexible panel 124 includes a hook 156 or other fastener to secure it to the window air conditioner 1. The flexible panel 124 may comprise a single sheet of flexible material, or multiple sheets that are held in a spaced relationship to provide an insulating airspace, as known in the art.

Figure 12:
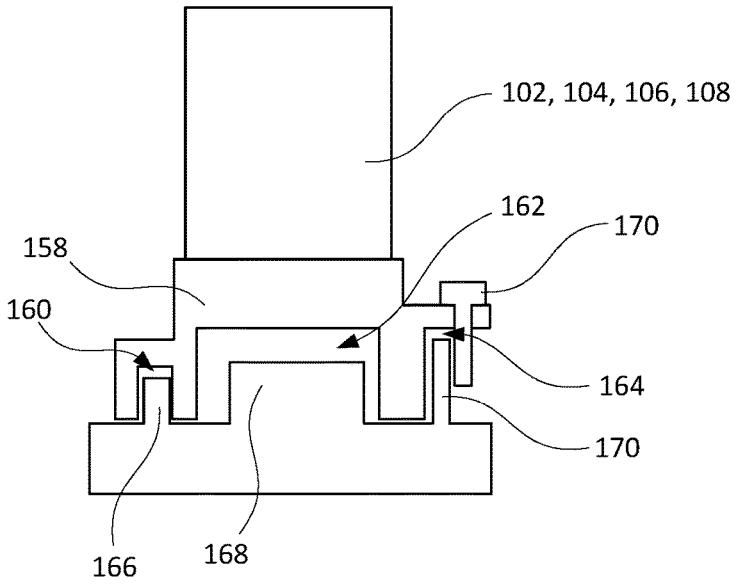
FIG. 12 is a side cutaway view of an alternative embodiment of profile shapes for a lower rail and/or other perimeter portions of the window installation system.

FIG. 12 shows an example of various profile shapes that may be used to define the outer perimeter region 158 (i.e., the portions facing the window sill or window frame) of one or more of the top rail 102, bottom rail 104, first vertical rail 106 and second vertical rail 108 (including upper and lower portions of the vertical rails). The outer perimeter region 158 may include one or more features 160, 162, 164 shaped to abut and/or surround different profile shapes of different window types. For example, certain windows may include one or more projecting lips 166, 168, 170 and the outer perimeter region 158 may have one or more recesses 160, 162, 164 or hooks that fit around such lips 166, 168 to help form an airtight seal and also provide mechanical interlocking to prevent movement of the window installation system 100 relative to the window. The recesses 160, 162, 164 or hooks may be formed integrally with the rail or rails (e.g., by forming them from a common extrusion), or formed separately and connected to the rail or rails. Also, one or more of the recesses, such as recess 164, may be formed with a movable or removable part, such as a drop-in pin 172 or screw, that fits into or is attached to part of the outer perimeter region 158 to form the recess 164. Other alternatives and variations will be apparent to persons of ordinary skill in the art in view of the present disclosure.

Embodiments of window installation systems such as the examples provided herein are expected to provide a secure and relatively simple and safe installation for window air conditioners. For example, the window installation system may be installed separately from and before the window air conditioner, which eases the burden to assemble the installation system to the window air conditioner, and then move the assembly into place in the window. This also allows the installer to lower the window sash into place to secure the window installation system before installing the window air conditioner, which eliminates to balance the window air conditioner in the window with one hand while sliding the sash with the other hand. Embodiments also may use a single clamp to hold the window installation system in the window, which eases installation, and the clamp may be located entirely outside the window to reduce the possibility of accidental release. Embodiments may also allow complete installation without using invasive fasteners to secure the parts to the window frame or sash.

While such benefits may be obtained in some embodiments, it will be understood that the claims are not necessarily limited to structures that achieve such benefits.

The present disclosure describes a number of inventive features and/or combinations of features that may be used alone or in combination with each other or in combination with other technologies. The embodiments described herein are all exemplary, and are not intended to limit the scope of the claims. It will also be appreciated that the inventions described herein can be modified and adapted in various ways, such as by replacing or adding features from one embodiment with those of another embodiment. All such modifications and adaptations are intended to be included in the scope of this disclosure and the appended claims.

The invention claimed is:

1. A window installation system for a window air conditioner, the window installation system comprising:

a top rail extending in a longitudinal direction from a first top rail end to a second top rail end;

a bottom rail extending in the longitudinal direction from a first bottom rail end to a second bottom rail end;

a first vertical rail extending in a vertical direction that is perpendicular to the longitudinal direction, the first vertical rail having a respective top end configured to attach to the top rail at the first top rail end, and a respective bottom end configured to attach to the bottom rail at the first bottom rail end; and a second vertical rail extending in the vertical direction, the second vertical rail having a respective top end configured to attach to the top rail at the second top rail end, and a respective bottom end configured to attach to the bottom rail at the second bottom rail end; and a clamp fixture connected to the top rail; and a clamp having a clamp face, wherein the clamp is movably mounted on the clamp fixture between a first clamp position in which the clamp face is a first distance from the top rail in a depth direction that is perpendicular to the longitudinal direction and the vertical direction, and a second clamp position in which the clamp face is a second distance from the top rail in the depth direction, wherein the top rail, bottom rail, first vertical rail, and second vertical rail are configured to define an opening shaped and dimensioned to receive the window air conditioner therein, and the window installation system is configured to connect to a window with the top rail secured to a window sash by the clamp, the bottom rail abutting a lower window sill, the first vertical rail abutting a first vertical window frame portion, and the second vertical rail abutting a second vertical window frame portion.

2. The window installation system of claim 1, further wherein the top rail, bottom rail, first vertical rail, second vertical rail and clamp are configured as separate parts that can be selectively assembled into a single assembly.

3. The window installation system of claim 1, wherein the window installation system is configured to receive the window air conditioner within the opening, and secure the window air conditioner to the window without fasteners other than the clamp.

4. The window installation system of claim 1, wherein the clamp is located on a first side of the top rail with respect to the depth direction, and the opening is dimensioned to allow access to the clamp from a second side of the top rail, opposite the first side of the top rail, when the window air conditioner is not within the opening.

5. The window installation system of claim 1, wherein the respective top end of the first vertical rail is configured to slidingly connect to the top rail at the first top rail end, and the respective bottom end of the first vertical rail is configured to slidingly connect to the bottom rail at the first bottom rail end.

6. The window installation system of claim 5, wherein the respective top end of the second vertical rail is configured to slidingly connect to the top rail at the second top rail end, and the respective bottom end of the second vertical rail is configured to slidingly connect to the bottom rail at the second bottom rail end.

7. The window installation system of claim 5, wherein the first vertical rail comprises a respective vertical portion extending in the vertical direction, a respective top longitudinal portion extending in the longitudinal direction and telescopically connectable to the top rail, and a respective bottom longitudinal portion extending in the longitudinal direction and telescopically connectable to the bottom rail.

8. The window installation system of claim 7, wherein the bottom longitudinal portion comprises:

a first bottom portion permanently fixed to the vertical portion and extending in the longitudinal direction from the vertical portion to a first bottom portion end; and a second bottom portion selectively connectable to the first bottom portion at the first bottom portion end, and extending in the longitudinal direction from the first bottom portion end to a second bottom portion end.

9. The window installation system of claim 7, further comprising a flexible panel connected to the vertical portion at a fixed edge and extending in the longitudinal direction to a free edge, wherein the flexible panel is extendable in the longitudinal direction to move the free edge towards the second vertical rail.

10. The window installation system of claim 9, wherein the top longitudinal portion comprises a top channel facing the bottom longitudinal portion, and the bottom longitudinal portion comprises a bottom channel facing the top longitudinal portion, and the flexible panel is captured in the depth direction within the top channel and the bottom channel.

11. The window installation system of claim 9, further comprising a connector configured to selectively secure the free edge to a window air conditioner located between the free edge and the second vertical rail.

12. The window installation system of claim 9, further comprising at least one magnet located at the free edge.

13. The window installation system of claim 9, wherein the flexible panel comprises a folded panel or a flexible sheet mounted on a rotatable spindle.

14. The window installation system of claim 1, wherein the clamp fixture comprises a first portion fixed to the top rail, and a second portion selectively mountable to the first portion, and wherein the clamp is movably mounted to the second portion.

15. The window installation system of claim 14, wherein the first portion comprises a first track extending from first side of the closure plate in the depth direction, and the second portion comprises a second track configured to slide on the first track.

16. The window installation system of claim 15, wherein the second track is configured to slide on the first track in a sliding direction parallel to the longitudinal direction.

17. The window installation system of claim 15, wherein one of the first track and the track comprises an external T-track or L-track and the other of the first track and the second track comprises an internal T-track or L-track.

18. The window installation system of claim 1, wherein the clamp and the clamp fixture comprise interlocking parts configured to hold the clamp at the second clamp position.

19. The window installation system of claim 18, wherein the interlocking parts comprise a one-way ratchet.

* * * * *